US011392158B2

(12) United States Patent
Malave-Perez et al.

(10) Patent No.: US 11,392,158 B2
(45) Date of Patent: Jul. 19, 2022

(54) LOW THRESHOLD VOLTAGE TRANSISTOR BIAS CIRCUIT

(71) Applicant: TEXAS INSTRUMENTS INCORPORATED, Dallas, TX (US)

(72) Inventors: Luis Ariel Malave-Perez, Forney, TX (US); Angelo William Pereira, Allen, TX (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 14 days.

(21) Appl. No.: 17/087,003

(22) Filed: Nov. 2, 2020

(65) Prior Publication Data

US 2022/0137659 A1 May 5, 2022

(51) Int. Cl.
*G05F 3/26* (2006.01)
*G05F 1/46* (2006.01)
*G05F 1/56* (2006.01)

(52) U.S. Cl.
CPC ..... *G05F 3/262* (2013.01); *G05F 1/461* (2013.01); *G05F 1/56* (2013.01)

(58) Field of Classification Search
CPC ..... G05F 3/262; G05F 1/461; G05F 1/56
See application file for complete search history.

(56) References Cited

U.S. PATENT DOCUMENTS 3,997,849 A * 12/1976 Thommen ..... H03F 3/3066 330/265
4,034,307 A * 7/1977 Schade, Jr. ..... G05F 3/262 330/288
5,757,226 A * 5/1998 Yamada ..... G05F 1/465 327/543
5,786,729 A * 7/1998 Smith ..... H03F 1/307 330/255
6,222,353 B1 * 4/2001 Pattamatta ..... G05F 1/465 323/901
6,249,175 B1 * 6/2001 Ebana ..... G05F 3/205 327/513

(Continued)

OTHER PUBLICATIONS

Prodanov V.I. and Green, M.M. "CMOS current mirrors with reduced input and output voltage requirements." IET Electronics Letters, vol. 32, No. Jan. 2 Jan. 18, 1996. (https://ieeexplore.ieee.org/abstract/document/490863), pp. 104-105.

(Continued)

*Primary Examiner* — Yusef A Ahmed
(74) *Attorney, Agent, or Firm* — Michael A. Davis, Jr.; Charles A. Brill; Frank D. Cimino

(57) ABSTRACT

A current mirror circuit includes a first current mirror transistor, a second current mirror transistor, and a bias circuit. The first current mirror transistor includes a gate and a drain. The second current mirror transistor includes a gate coupled to the gate of the first current mirror transistor. The first current mirror transistor and the second current mirror transistor are low threshold voltage transistors. The bias circuit is coupled to the gate and the drain of the first current mirror transistor. The bias circuit is configured to bias the first current mirror transistor to operate in a saturation mode when a threshold voltage of the first current mirror transistor is a negative voltage.

15 Claims, 6 Drawing Sheets

(56) References Cited

U.S. PATENT DOCUMENTS 6,300,752 B1* 10/2001 Mack ..... G05F 3/205 327/530
6,414,553 B1* 7/2002 Luo ..... H03F 1/302 330/296
6,781,417 B1* 8/2004 Le ..... G05F 3/242 326/27
10,802,517 B1* 10/2020 Assaad ..... G05F 1/468
2001/0035776 A1* 11/2001 Pavan ..... G05F 3/262 327/103
2002/0042176 A1* 4/2002 Ikehashi ..... H03F 3/345 438/200
2006/0033576 A1* 2/2006 Luo ..... H03F 1/0261 330/296
2006/0158256 A1* 7/2006 Luo ..... H03F 3/189 330/296
2009/0146741 A1* 6/2009 Okuma ..... H03F 3/195 330/306
2010/0127765 A1* 5/2010 Vice ..... G05F 3/262 327/543
2010/0141344 A1* 6/2010 Kim ..... G05F 3/30 330/289
2011/0074370 A1* 3/2011 Imura ..... G05F 1/573 323/277
2013/0285674 A1* 10/2013 Chiang ..... G01R 31/40 324/609
2015/0185754 A1* 7/2015 Liu ..... G05F 3/267 323/313
2016/0349785 A1* 12/2016 Ciubotaru ..... G05F 3/262
2018/0034414 A1* 2/2018 Niu ..... H03F 3/245
2018/0284824 A1* 10/2018 Manohar ..... G05F 1/575
2020/0081477 A1* 3/2020 Horng ..... G05F 3/30
2021/0303012 A1* 9/2021 Yuk ..... G05F 1/59

OTHER PUBLICATIONS

You, F. et al. "An Improved Current Source for Low Voltage Applications." IEEE 1006 Custom Integrated Circuits Conference, pp. 97-100.

Strandvik, E. "Compensation of threshold voltage for process variations in 28nm UTBB FDSOI" NTNU, TFE4550 Specialization project, No. 1, Dec. 2014, 76 pages.

"Chapter 11: The Current Mirror." (Sep. 17, 2018). retrieved from: https://wiki.analog.com/university/courses/electronics/text/chapter-11. pp. 2-22.

* cited by examiner

400

VDD
226
442
432
424D
424G
424S
424
428S
428G
428D
428
440
426
426G
426D
426S
422
422G
422S
422D
220B
220
220A
420
420G
420D
420S
406
410
Vshift2
VSS
228
404S
404G
404D
404
414S
414G
414D
414
LVT
412
412G
412S
412D
408
208D
208G
208S
208
206
206G
206D
206S
202
Cout
Vout
402S
402G
402D
402
Vshift1
200
204

LOW THRESHOLD VOLTAGE TRANSISTOR BIAS CIRCUIT

BACKGROUND

Transistors can be fabricated with various threshold voltages. Threshold voltage is the voltage that must be applied to the gate region to induce current flow between source and drain of the transistor. Metal oxide semiconductor field effect transistors (MOSFETs) can be fabricated to have a standard threshold voltage (e.g., 0.6 volt threshold) or a low threshold voltage (e.g., 0.15 volt threshold). Low threshold voltage transistors can be used to realize circuits that operate with lower power supply voltages than is possible with standard voltage threshold transistors. Circuit power consumption can be reduced by using lower power supply voltages.

SUMMARY

A bias circuit for maintaining saturation mode operation of a low-threshold voltage transistor is disclosed herein. In one example, a circuit includes a power supply terminal, a ground terminal, a low threshold voltage transistor, and a bias circuit. The low threshold voltage transistor includes a gate and a drain. The bias circuit includes a first bias circuit transistor, a second bias circuit transistor, and a resistor. The first bias circuit transistor includes a first current terminal and a second current terminal. The first current terminal is coupled to the power supply terminal. The second bias current transistor includes a first current terminal and a second current terminal. The first current terminal of the second bias current transistor is coupled to the ground terminal. The resistor is coupled to the second current terminal of the first bias circuit transistor and the second current terminal of the second bias circuit transistor. The resistor is also coupled between the gate of the low threshold voltage transistor and the drain of the low threshold voltage transistor.

In another example, a current mirror circuit includes a first current mirror transistor, a second current mirror transistor, and a bias circuit. The first current mirror transistor includes a gate and a drain. The second current mirror transistor includes a gate coupled to the gate of the first current mirror transistor. The first current mirror transistor and the second current mirror transistor are low threshold voltage transistors. The bias circuit is coupled to the gate and the drain of the first current mirror transistor. The bias circuit is configured to bias the first current mirror transistor to operate in a saturation mode when a threshold voltage of the first current mirror transistor is a negative voltage.

In a further example, a linear voltage regulator includes a current mirror circuit and a bias circuit. The current mirror circuit includes a first current mirror. The first current mirror includes a first low threshold voltage transistor and a second low voltage threshold transistor. The first low threshold voltage transistor includes a gate and a drain. The second low threshold voltage transistor includes a gate coupled to the gate of the first low voltage threshold transistor. The bias circuit includes a resistor coupled between the drain of the first low threshold voltage transistor and the gate of the first low threshold voltage transistor. The resistor is also coupled between a second current mirror and a third current mirror.

DETAILED DESCRIPTION

Metal oxide semiconductor field effect transistors (MOSFETs) are generally fabricated to have one of three threshold ranges. In natural threshold voltage transistors, the threshold voltage is not altered by use of implants or body doping, and is about 0 volts (V)+/−0.1V. In low threshold voltage transistors, the threshold voltage is altered slightly by using implants or body doping, and is about 0.15V+/−0.1V. In standard threshold voltage transistors, the threshold voltage is set by use of implants or body doping, and is about 0.6V to 0.8V with spread of about +/−0.05V. Standard threshold voltage transistors are usable in a broad range of low leakage, analog and digital applications. However, due to the higher threshold voltage, the minimum power supply voltage usable with standard threshold voltage transistors is higher than that of the natural and low threshold voltage transistors.

In low threshold voltage transistors, the threshold voltage may change polarity (e.g., from positive to negative) at higher temperatures and process corner extremes. Because the threshold voltage of low threshold voltage transistors can be negative, saturation of the low threshold voltage transistor cannot be guaranteed when diode connected, and, therefore, diode connection cannot be used to implement current mirrors with low threshold voltage transistors over a wide temperature range, such as a grade 1 (−40 C to 125 C) or grade 0 (−40 C to 150 C) automotive requirement.

A bias circuit that enables saturation mode operation of a low threshold voltage transistor even when the threshold voltage of the transistor is negative is described herein. The bias circuit allows low threshold voltage transistors to be used in current mirrors and other circuits as part of applications that benefit from reduced power supply voltages, such as low dropout linear voltage regulators, while retaining the ability to operate over a wide temperature range.

Figure 1:
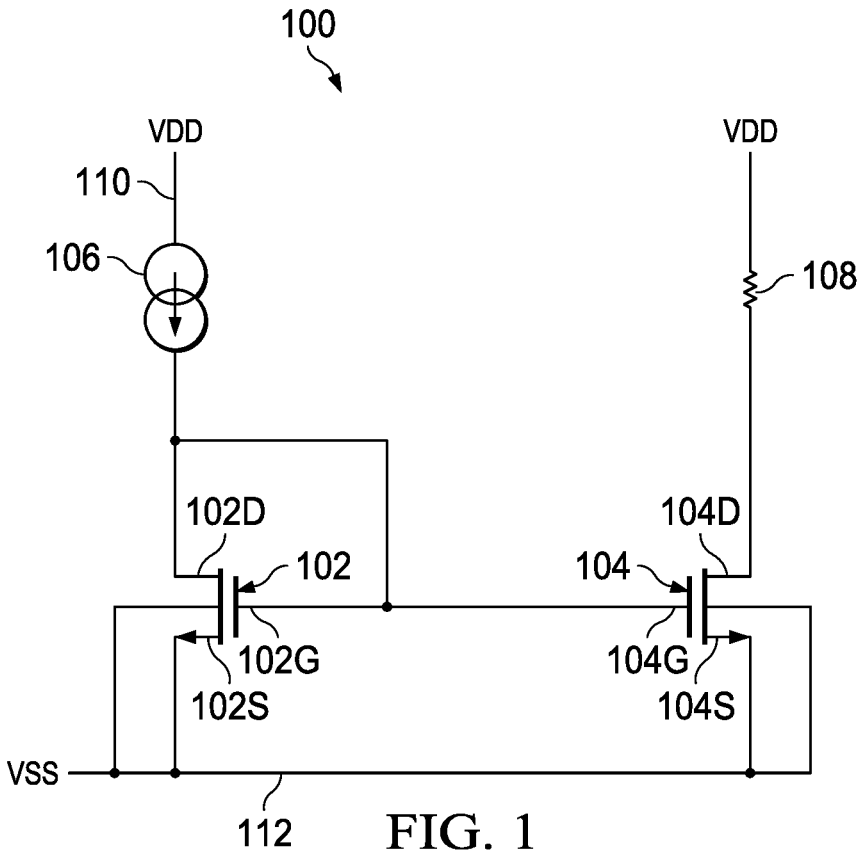
FIG. 1 (PRIOR ART)
FIG. 1 shows a schematic diagram for a conventional current mirror using a diode-connected low threshold voltage transistor.

FIG. 1 shows a schematic diagram for a current mirror 100 (a conventional current mirror) using a diode-connected low threshold voltage transistor. The current mirror 100 includes a transistor 102, a transistor 104, a current source 106, and a resistor 108. The transistor 102 and the transistor 104 are low threshold voltage transistors. The transistor 102 is diode-connected. The source terminal 102S of the transistor 102 is coupled to a ground terminal 112. The gate terminal 102G of the transistor 102 is coupled to the drain terminal 102D of the transistor 102. The current source 106 is coupled to a power supply terminal 110 and to the drain terminal 102D of the transistor 102.

The source terminal 104S of the transistor 104 is coupled to the ground terminal 112. The gate terminal 104G of the transistor 104 is coupled to the gate terminal 102G of the transistor 102. The resistor 108 is coupled to a power supply terminal 110 and to the drain terminal 104D of the transistor 104. Current flow from the current source 106 through the transistor 102 is mirrored in the transistor 104. In some current mirrors (e.g., current mirrors using diode-connected standard threshold transistor), operation of the transistors in saturation mode is guaranteed by providing drain-to-source voltage ($V_{DS}$) that is greater than or equal to the gate-to-source voltage ($V_{GS}$) less the threshold voltage ($V_{TH}$) of the transistors ($V_{DS} \geq V_{GS} - V_{TH}$). With standard threshold voltage transistors, the threshold voltage is always positive, and with $V_{DS}=V_{GS}$ the transistors operate in saturation mode. However, because the transistor 102 and the transistor 104 are low threshold voltage transistors, the threshold voltage changes polarity at high temperatures and becomes negative. With a negative threshold voltage, $V_{DS}=V_{GS}$ will not provide operation in saturation mode. The transistor 102 and the transistor 104 may operate in a linear region, and the difference (error) in the currents flowing in the transistor 102 and the transistor 104 can be high (e.g., 50%-100% error), making the current mirror 100 unsuitable for use in most applications.

Figure 2:
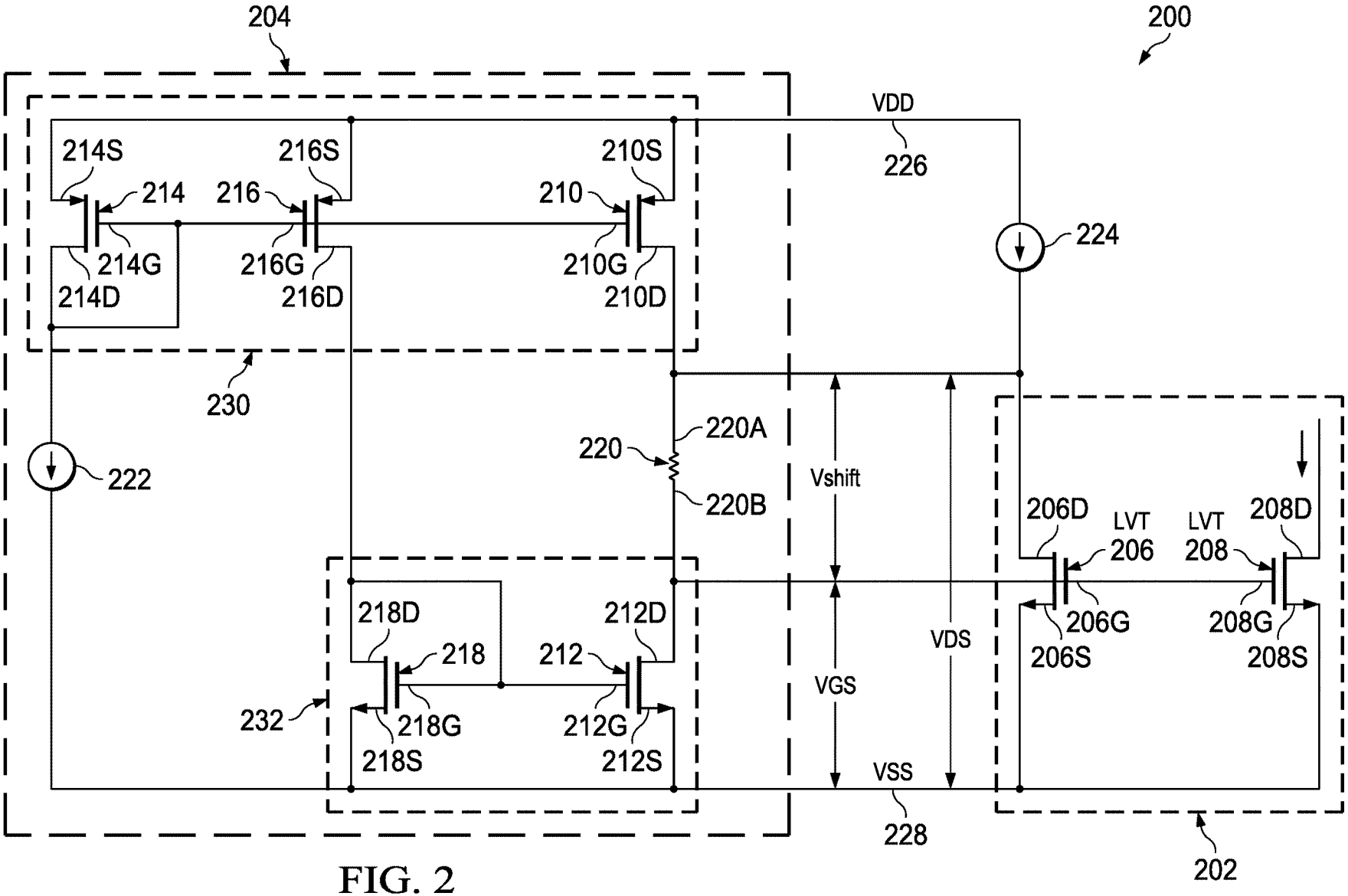
FIG. 2 shows a schematic diagram for a current mirror circuit that includes a bias circuit that maintains saturation mode operation of the low threshold voltage transistors.

FIG. 2 shows a schematic diagram for current mirror circuit 200 that includes a bias circuit that maintains saturation mode operation of the low threshold voltage transistors at high temperatures. The current mirror circuit 200 includes a current mirror 202, a bias circuit 204, and a current source 224. The current mirror 202 includes a current mirror transistor 206 and a current mirror transistor 208. The current mirror transistor 206 and the current mirror transistor 208 are low threshold voltage transistors. In various implementations, the current mirror transistor 206 and the current mirror transistor 208 may be n-channel metal oxide semiconductor field effect transistors (MOSFETs) or p-channel MOSFETs. The gate terminal 206G of the current mirror transistor 206 is coupled to the gate terminal 208G of the current mirror transistor 208. The source terminal 206S of the current mirror transistor 206 is coupled to the ground terminal 228. The source terminal 208S of the current mirror transistor 208 is also coupled to the ground terminal 228. The drain terminal 206D of the current mirror transistor 206 is coupled to the current source 224. Current flowing in the drain terminal 206D of the current mirror transistor 206 is mirrored by current flowing in the drain terminal 208D of the current mirror transistor 208.

The current mirror transistor 206 is not diode-connected like the transistor 102 of the current mirror 100. The drain terminal 206D and the gate terminal 206G of the current mirror transistor 206 are coupled to the bias circuit 204. The bias circuit 204 biases the current mirror 202 to maintain operation in saturation mode over temperature. The bias circuit 204 includes a resistor 220, a current source 222, a current mirror 230, and a current mirror 232. The resistor 220 is connected across the drain terminal 206D and the gate terminal 206G of the current mirror transistor 206. The current mirror 230 and the current mirror 232 control current flow in the resistor 220. In the current mirror circuit 200, the drain-source voltage of the current mirror transistor 206 is the gate-source voltage of the current mirror transistor 206 plus the voltage across the resistor 220 ($V_{shift}$) ($V_{DS}=V_{GS}+V_{shift}$). Drain-source voltage produced using a suitably chosen $V_{shift}$ voltage allows the current mirror transistor 206 to operate in saturation mode even when the threshold voltage of the current mirror transistor 206 is negative. If $V_{shift}$ is too large, then operation with low power supply voltages is inhibited. If $V_{shift}$ is too small, then compensation for the change in threshold voltage polarity is inadequate. A $V_{shift}$ voltage of 50-100 millivolts provides improved performance in implementations of the current mirror circuit 200. In the current mirror circuit 200, the error in mirrored current may be significantly less than (e.g., less than 5% error between the current in the current mirror transistor 206 and the current mirror transistor 208) the error current in the current mirror 100.

The resistor 220 includes a terminal 220A coupled to the drain terminal 206D of the current mirror transistor 206, and a terminal 220B coupled to the gate terminal 206G of the current mirror transistor 206. The current mirror 230 sources current to the resistor 220, and the current mirror 232 sinks current from the resistor 220. The current mirror 230 includes a bias circuit transistor 210, a bias circuit transistor 214, and a bias circuit transistor 216. The bias circuit transistor 210, the bias circuit transistor 214, and the bias circuit transistor 216 are standard threshold voltage transistors. The bias circuit transistor 210, the bias circuit transistor 214, and the bias circuit transistor 216 may be p-channel MOSFETs. The bias circuit transistor 214 is diode-connected. The bias circuit transistor 214 includes source terminal 214S coupled to the power supply terminal 226, a drain terminal 214D coupled to the current source 222, and a gate terminal 214G coupled to the drain terminal 214D of the bias circuit transistor 214. The bias circuit transistor 216 includes a source terminal 216S coupled to the power supply terminal 226, and a gate terminal 216G coupled to the gate terminal 214G of the bias circuit transistor 214. The bias circuit transistor 210 includes a source terminal 210S coupled to the power supply terminal 226, a gate terminal 210G coupled to the gate terminal 214G of the bias circuit transistor 214, and a drain terminal 210D coupled to the terminal 220A of the resistor 220. The current flow through bias circuit transistor 214 is mirrored in the bias circuit transistor 216 and the bias circuit transistor 210. The current flowing through the bias circuit transistor 214 may be relatively low (e.g., 100 nanoamperes).

Because the value of $V_{shift}$ is of the order of 100 millivolts (mV) typically, some implementations of the resistor 220 are realized using a high sheet resistance resistor of value 1 MegOhm into which a current of 100 mV/1 MegOhm=0.1 microamperes (uA) or 100 nanoamperes (nA) is sunk. This makes the bias circuit 204 have a low quiescent current (IQ) penalty. High sheet resistors are also realized with a small area. Thus, the bias circuit 204 has low IQ and low area overhead. In some implementations of the current mirror circuit 200, the resistor 220 is implemented using a MOSFET.

The value of current in resistor 220 is also chosen to be 10X smaller than that sourced from the current source 224 so that errors due to cross feeding of current between the branch to the current mirror transistor 206 and the branch formed by the resistor 220, and the bias circuit transistor 212 are minimized. Making the current of the resistor 220 very small is a reliable method to ensure the cross feeding is low.

The current mirror 232 includes a bias circuit transistor 212 and a bias circuit transistor 218. The bias circuit transistor 212 and the bias circuit transistor 218 are standard threshold voltage transistors. The bias circuit transistor 212 and the bias circuit transistor 218 may be n-channel MOSFETs. The bias circuit transistor 218 is diode-connected. The bias circuit transistor 218 includes a source terminal 218S coupled to the ground terminal 228, a drain terminal 218D coupled to the drain terminal 216D of the bias circuit transistor 216, and a gate terminal 218G coupled to the drain terminal 218D. The bias circuit transistor 212 includes a drain terminal 212D coupled to the terminal 220B of the resistor 220, a source terminal 212S coupled to the ground terminal 228, and a gate terminal 212G coupled to the gate terminal 218G of the bias circuit transistor 218.

The bias circuit transistors 214, 216, 210, 218, 212 are sized so as to impose an no area penalty of significance. Mismatch specifications of the bias circuit 204 are relaxed as the goal is to achieve a reasonable value and range of variation in $V_{shift}$. The bias circuit transistors 210 and 212 respectively source and sink a same current making $V_{shift}$ a floating voltage source applied between the drain terminal 206D and the gate terminal 206G of the current mirror transistor 206. The use of the bias circuit transistor 210 and the bias circuit transistor 212 ensures that the current in the resistor 220 does not divert into any other circuit branch. The position of the bias circuit transistor 212 is such as to freely permit the current mirror transistor 206 to set its gate terminal potential to meet the requirement to sink the current of the current source 224. Because the drain of the bias circuit transistor 212 offers a high impedance looking into it, the bias circuit transistor 212 can stay in saturation with the gate voltage of the current mirror transistor 206 imposed on it, and provide the $V_{shift}$ lift to the drain voltage of the current mirror transistor 206, using the resistor 220.

Some examples of the bias circuit 204 are implemented with bipolar junction transistors rather than MOSFETs. For example, the bias circuit transistors 210, 214, and 216 are PNP bipolar junction transistors, and the bias circuit transistors 212 and 218 are NPN bipolar junction transistors.

Figure 3:
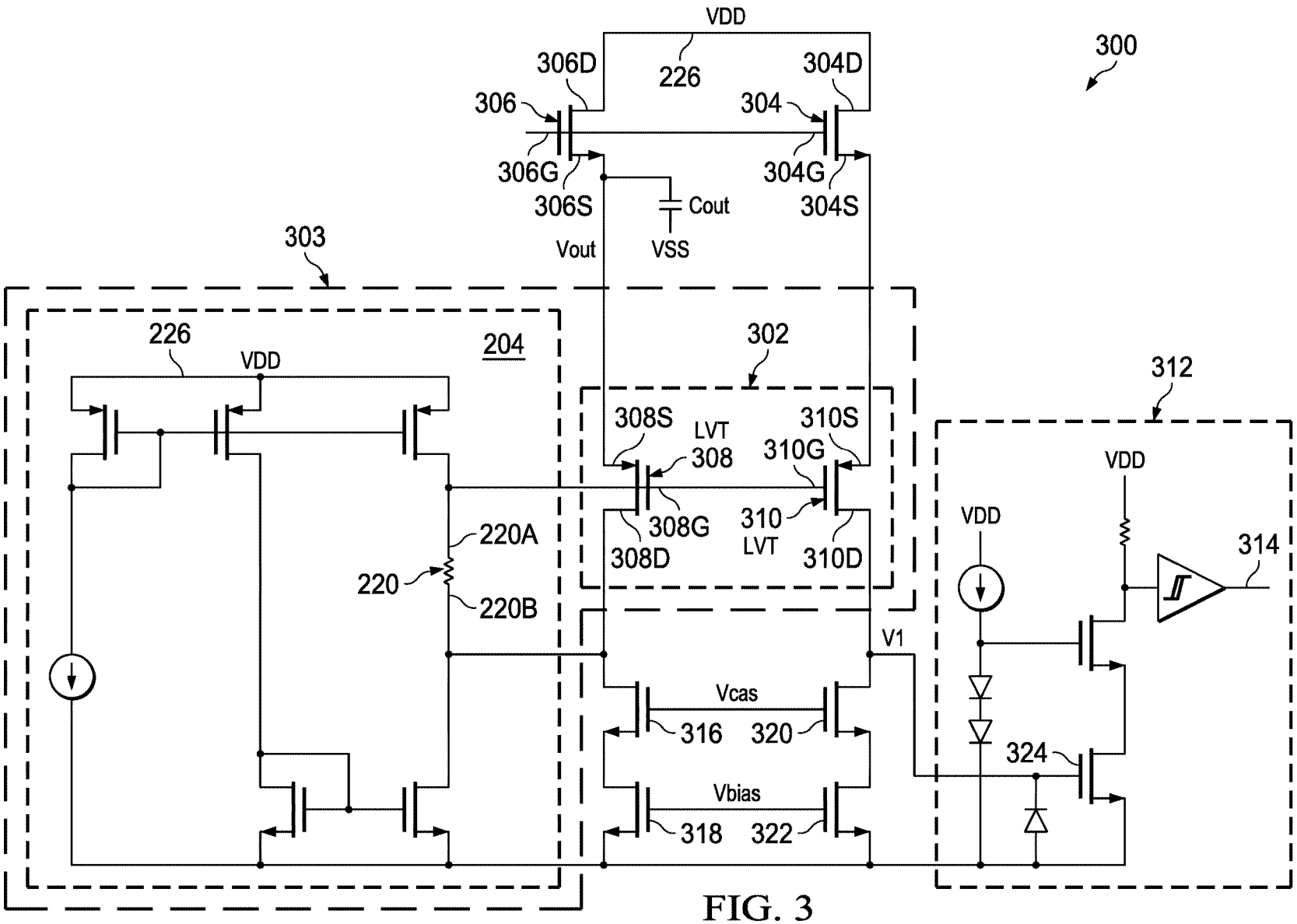
FIG. 3 shows a schematic diagram for a portion of a low dropout linear voltage regulator that includes a current mirror circuit that includes a bias circuit to maintain saturation mode operation of the low threshold voltage transistors.

FIG. 3 shows a schematic diagram for a portion of a linear voltage regulator 300 (a low dropout linear voltage regulator) that sets a current limit for protecting the 300 and attached load circuit from over currents or short circuits. The linear voltage regulator 300 includes a power transistor 306, a replica transistor 304, and a current mirror circuit 303. The power transistor 306 sources current to power a load circuit. The replica transistor 304 is a much smaller instance of the power transistor 306 that passes a downscaled version of the load current flowing in the power transistor 306. The current mirror circuit 303 is a p-channel implementation of the current mirror circuit 200. The power transistor 306 and the replica transistor 304 are n-channel MOSFETs. The current mirror circuit 303 includes a current mirror 302 and the bias circuit 204. Use of the current mirror circuit 303 in current limit detection circuitry of the linear voltage regulator 300 allows the implementations of the linear voltage regulator 300 to operate with an output voltage (Vout) as low as 0.6 volts. Such a low output voltage support would be highly impractical with standard threshold voltage transistors whose threshold voltage would be of the order of 0.5-0.6V and hence there would be no head room remaining for the load circuit below the current mirror 302.

The current mirror circuit 303 includes a current mirror transistor 308 and a current mirror transistor 310. The current mirror transistor 308 and the current mirror transistor 310 are low threshold voltage transistors (p-channel MOSFETs). The gate terminal 308G of the current mirror transistor 308 is coupled to the gate terminal 310G of the current mirror transistor 310. The source terminal 308S of the current mirror transistor 308 is coupled to the source terminal 306S of the power transistor 306. The source terminal 310S of the current mirror transistor 310 is coupled to the source terminal 304S of the replica transistor 304. Current flowing in the current mirror transistor 308 is mirrored by current flowing in the current mirror transistor 310.

The current mirror transistor 308 is not diode-connected. The drain terminal 308D and the gate terminal 308G of the current mirror transistor 308 are coupled to the bias circuit 204. The gate terminal 308G of the current mirror transistor 308 is coupled to the terminal 220A of the resistor 220, and the drain terminal 308D of the current mirror transistor 308 is coupled to the terminal 220B of the resistor 220.

The transistors 316, 318, 320, and 322 are coupled to the current mirror 302. The gate terminals of the transistors 316 and 320 are set voltage VCAS, and the gate terminals of the transistors 318 and 322 are set VBIAS with a constant reference current (not shown). When the current in the power transistor 306 exceeds a predefined limit, the NMOS current reference formed by the transistors 316, 318, 320, and 322 not be able to provide the current desired by the replica transistor 304 and the transistor 310, and the node V1 is pulled to a logic high state. The node V1 is coupled to the output circuit 312, and when the node V1 is pulled to the logic high state, the transistor 324 is turned on, and in turn the signal 314 is pulled to a logic low state indicate that the current flowing in the power transistor 306 has exceeded the predefined limit.

Figure 4:
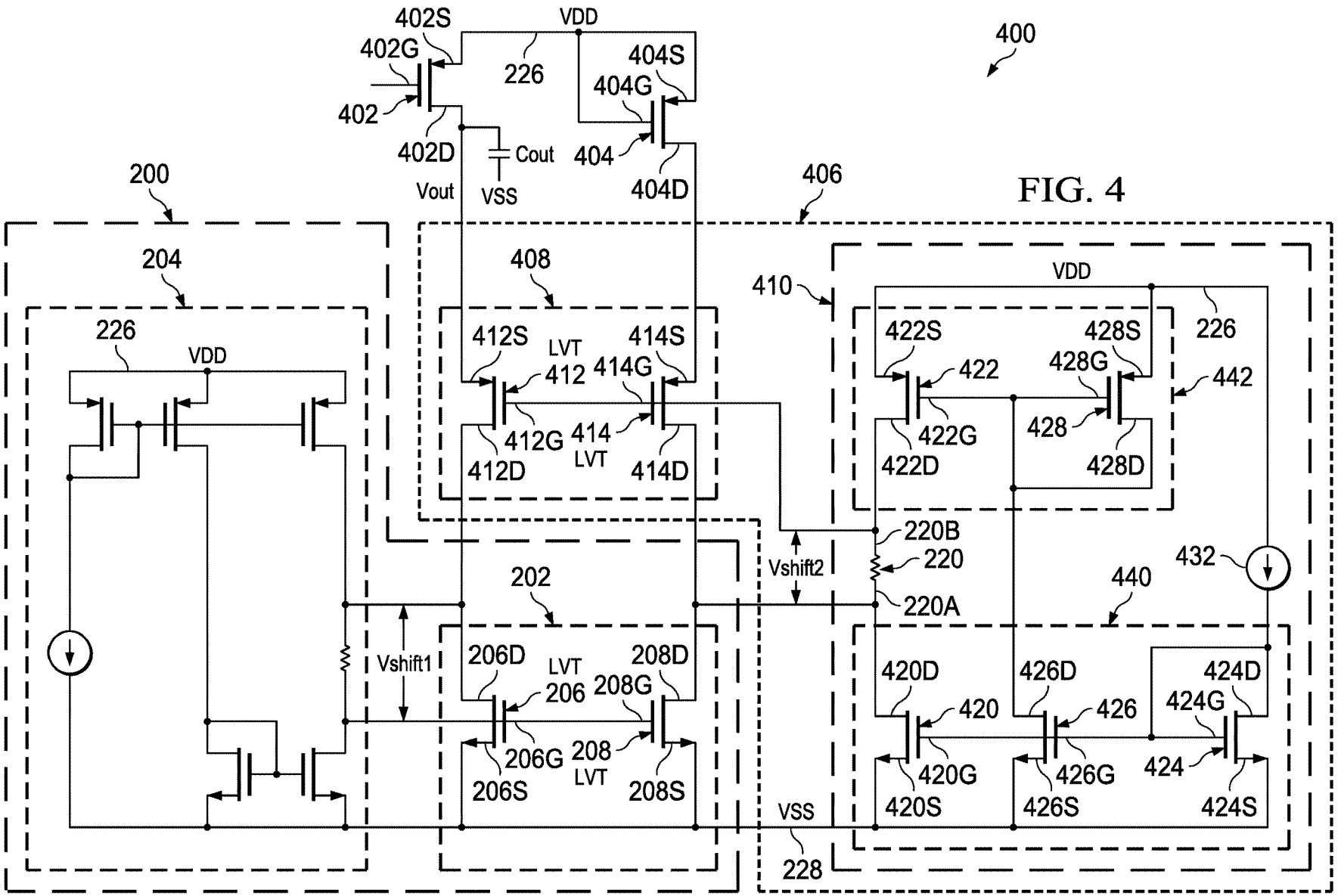
FIG. 4 shows a schematic diagram for a portion of a low dropout linear voltage regulator that include current mirror circuits that include bias circuits to maintain saturation mode operation of the low threshold voltage transistors.

FIG. 4 shows a schematic diagram for a portion of a linear voltage regulator 400 (a low dropout linear voltage regulator) that provides leakage compensation when operating with no load or a very small load. The linear voltage regulator 400 includes a power transistor 402, a replica transistor 404, an instance of the current mirror circuit 200, and a current mirror circuit 406. The power transistor 402 and the replica transistor 404 are p-channel MOSFETs. The replica transistor 404 is a scaled-down (e.g., N:1, where N is 100-1000) instance of the power transistor 402.

The gate terminal 404G of the replica transistor 404 is coupled to the source terminal 404S of the 404 so that the only drain current is due to various MOSET leakage mechanisms such as subthreshold leakage. When there is no load, leakage current of the power transistor 402 can charge up an output capacitor COUT coupled to the drain terminal 402D of the power transistor 402. The capacitor COUT could in theory charge up to VDD and cause damage to the load circuits. The control loop of the regulator is, at best, able to pull the gate terminal 402G of the power transistor 402 to the same potential as VDD, which is inadequate to throttle the leakage current of the power transistor 402. In the low dropout linear voltage regulator 400, the current mirror circuit 200 and a current mirror circuit 406 provide leakage compensation for low power supply voltage and low output voltage.

The current mirror circuit 406 is a p-channel implementation of the current mirror circuit 200. The current mirror circuit 200 and the current mirror circuit 406 compensate for leakage in the power transistor 402 for output voltages as low as 0.5 volts over a wide temperature range.

The current mirror circuit 406 includes a current mirror 408 and a bias circuit 410. The current mirror 408 includes a current mirror transistor 412 and a current mirror transistor 414. The current mirror transistor 412 and the current mirror transistor 414 are low threshold voltage transistors (p-channel MOSFETs). The gate terminal 412G of the current mirror transistor 412 is coupled to the gate terminal 414G of the current mirror transistor 414. The source terminal 412S of the current mirror transistor 412 is coupled to the drain terminal 402D of the power transistor 402. The source terminal 414S of the current mirror transistor 414 is coupled to the drain terminal 404D of the replica transistor 404.

Current flowing in the current mirror transistor 412 is mirrored by current flowing in the current mirror transistor 414.

The current mirror transistor 414 is not diode-connected. The drain terminal 414D and the gate terminal 414G of the current mirror transistor 414 are coupled to the bias circuit 410. The bias circuit 410 biases the current mirror 408 to maintain operation in saturation mode over temperature. The bias circuit 410 includes the resistor 220, a current source 432, a current mirror 440, and a current mirror 442. The resistor 220 is connected across the drain terminal 414D and gate terminal 414G of the current mirror transistor 414. The current mirror 440 and the current mirror 442 control current flow in the resistor 220. The drain terminal 412D of the current mirror transistor 412 is coupled to the drain terminal 206D of the current mirror transistor 206, and the drain terminal 414D of the current mirror transistor 414 is coupled to the drain terminal 208D of the current mirror transistor 208. In the linear voltage regulator 400, the drain-source voltage produced using the voltage across the resistor 220 ($V_{shift}$) allows the current mirror transistor 414 and the current mirror transistor 412 to operate in saturation mode even when the threshold voltage of the current mirror transistors 412 and 414 is negative.

The resistor 220 of the bias circuit 410 includes a terminal 220A coupled to the drain terminal 414D of the current mirror transistor 414, and a terminal 220B coupled to the gate terminal 414G of the current mirror transistor 414. The current mirror 442 sources current to the resistor 220, and the current mirror 440 sinks current from the resistor 220. The current mirror 440 includes a bias circuit transistor 420, a bias circuit transistor 424, and a bias circuit transistor 426. The bias circuit transistor 420, the bias circuit transistor 424, and the bias circuit transistor 426 are standard threshold voltage transistors. The bias circuit transistor 420, the bias circuit transistor 424, and the bias circuit transistor 426 may be n-channel MOSFETs. The bias circuit transistor 424 is diode-connected. The bias circuit transistor 424 includes source terminal 424S coupled to the ground terminal 228, a drain terminal 424D coupled to the current source 432, and a gate terminal 424G coupled to the drain terminal 424D of the bias circuit transistor 424. The bias circuit transistor 426 includes a source terminal 426S coupled to the ground terminal 228, and gate terminal 426G coupled to the gate terminal 424G of the bias circuit transistor 424. The bias circuit transistor 420 includes a source terminal 420S coupled to the ground terminal 228, a gate terminal 420G coupled to the gate terminal 424G of the bias circuit transistor 424, and a drain terminal 420D coupled to the terminal 220A of the resistor 220. The current flow through bias circuit transistor 424 is mirrored in the bias circuit transistor 426 and the bias circuit transistor 420. The current flowing through the bias circuit transistor 424 may be relatively low (e.g., 100 nanoamperes).

The current mirror 442 includes a bias circuit transistor 422 and a bias circuit transistor 428. The bias circuit transistor 422 and the bias circuit transistor 428 are standard threshold voltage transistors. The bias circuit transistor 422 and the bias circuit transistor 428 may be p-channel MOSFETs. The bias circuit transistor 428 is diode-connected. The bias circuit transistor 428 includes a source terminal 428S coupled to the power supply terminal 226, a drain terminal 428D coupled to the drain terminal 426D of the bias circuit transistor 426, and a gate terminal 428G coupled to the drain terminal 428D. The bias circuit transistor 422 includes a drain terminal 422D coupled to the terminal 220B of the resistor 220, a source terminal 422S coupled to the power supply terminal 226, and a gate terminal 422G coupled to the gate terminal 428G of the bias circuit transistor 428.

Some examples of the bias circuit 410 are implemented with bipolar junction transistors rather than MOSFETs. For example, the bias circuit transistors 420, 424, and 426 are NPN bipolar junction transistors, and the bias circuit transistors 422 and 428 are PNP bipolar junction transistors.

The leakage of the power transistor 402 is replicated in the replica transistor 404. The replicated leakage is scaled back up using the current mirror 202 and discharged from the output capacitor COUT coupled to the drain terminal 402D of the power transistor 402. If the mirrors are accurate, then the leakage of the power transistor 402 is diverted into the current mirror transistor 412, and the current mirror transistor 206 and the COUT capacitor voltage does not rise.

Figure 5:
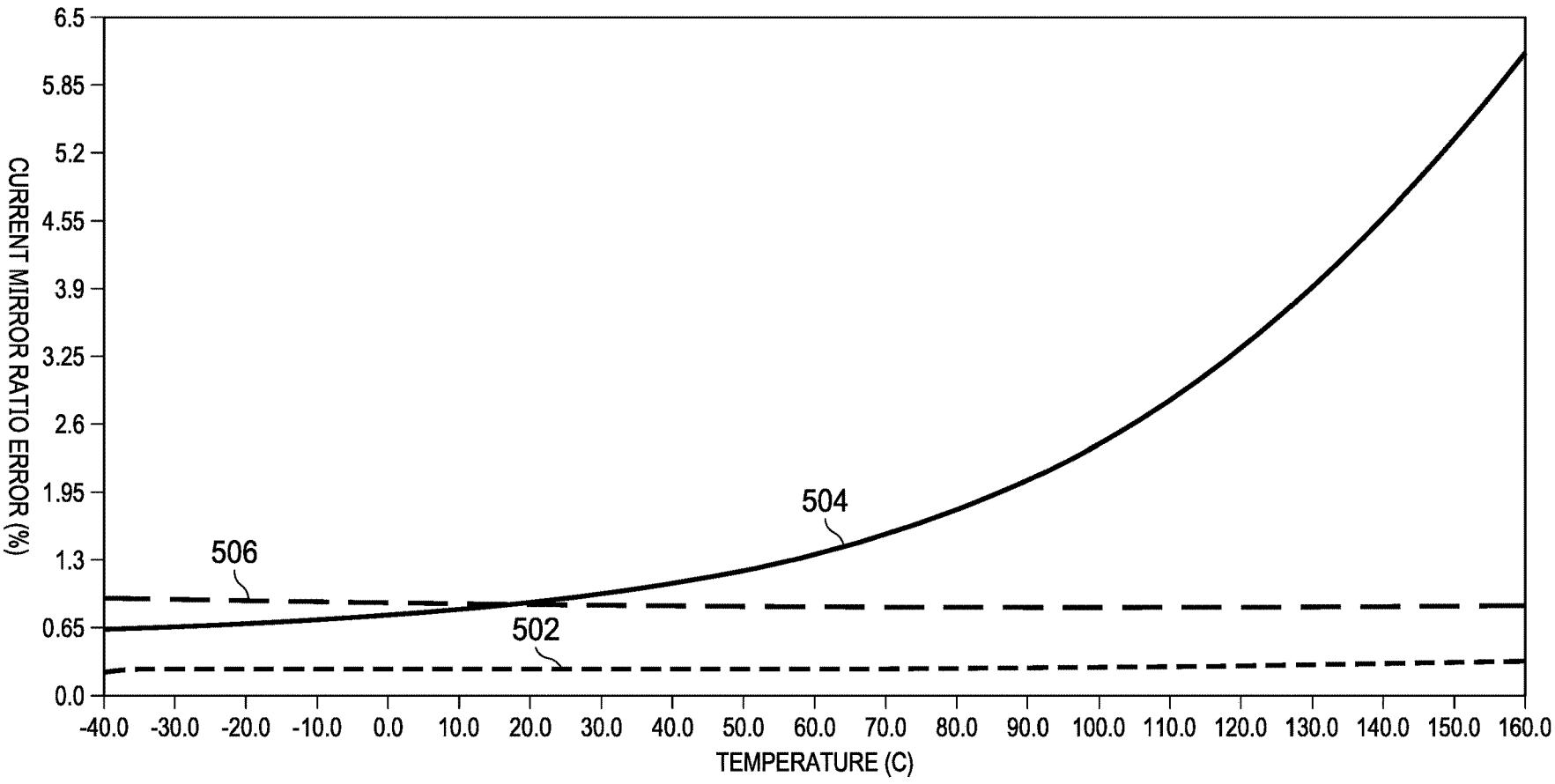
FIG. 5 shows a comparison of error versus temperature for the current mirror circuit of FIG. 2 and current mirror circuits using diode-connected transistors.

FIG. 5 shows a comparison of error in current mirror ratio expressed as a percentage of the current in the diode-connected leg (also known as the reference current) versus temperature for various current mirror circuits. Error 504 of the current mirror 100 increases significantly due to linear mode operation with increasing temperature. Error 506 of a current mirror using standard threshold voltages (e.g., an implementation of the current mirror 100) does not increase with temperature. Error 502 of the current mirror circuit 200, the current mirror circuit 303, or the current mirror circuit 406 is stable over temperature and is lower than error 506 or error 504.

Figure 6:
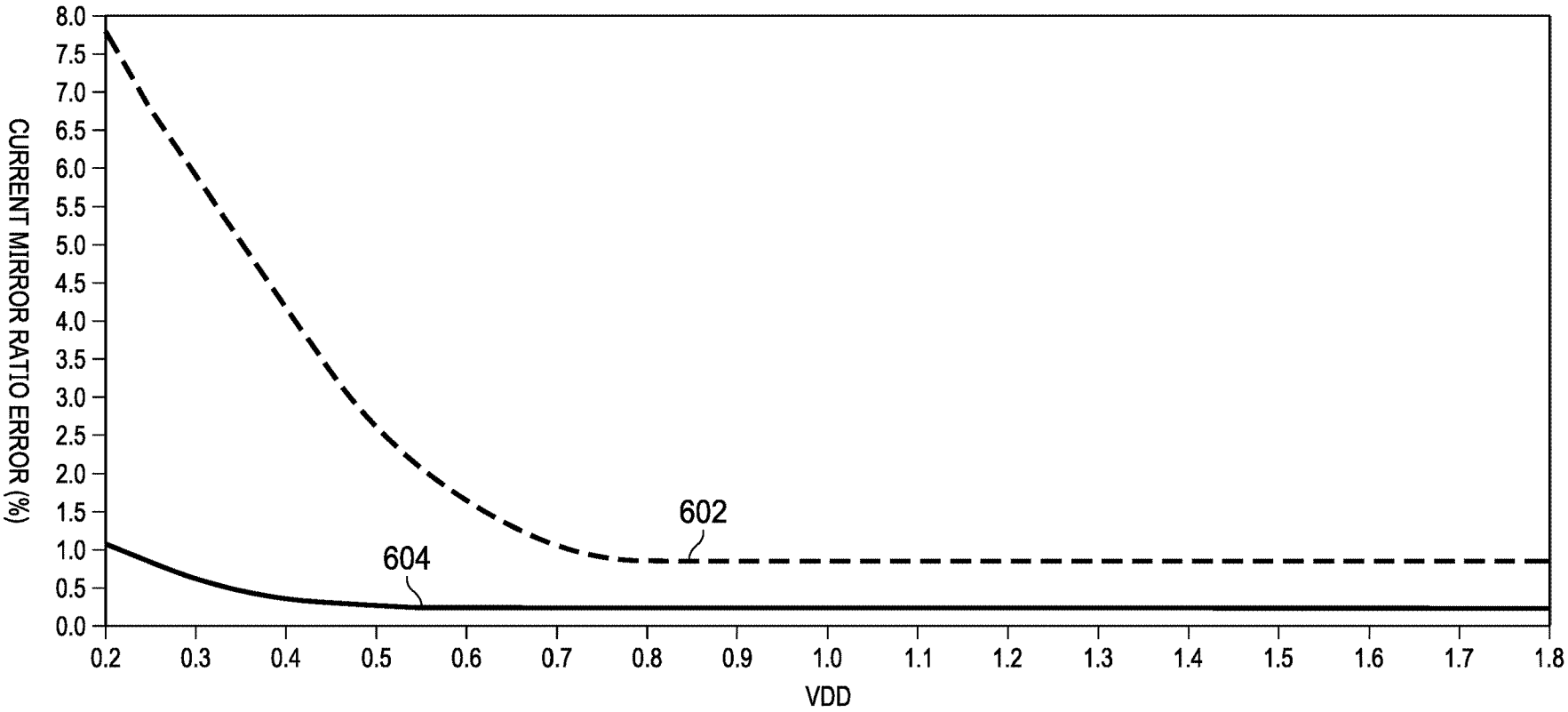
FIG. 6 shows a comparison of error versus power supply voltage for the current mirror circuit of FIG. 2 and a current mirror circuit using a diode-connected standard threshold voltage transistor.

FIG. 6 shows a comparison of current mirror ratio error (%) versus power supply voltage for current mirror circuits using the bias circuits described herein, and a current mirror circuit using a diode-connected standard threshold voltage transistor. The error 604 in current mirror circuits using low threshold voltage transistors and the bias circuits described herein (e.g., the current mirror circuit 200, the current mirror circuit 303, or the current mirror circuit 406) is significantly lower at low power supply voltages than the error 602 produced in a current mirror circuit that uses standard threshold voltage transistors. Moreover, using low threshold voltage transistors and the bias circuits described herein, the error is maintained below 0.5% for power supply voltages as low as 0.4 volts. Using diode-connected standard threshold transistors the error is as high as 4%, which affects the accuracy of the application circuit (e.g., the accuracy of the leakage compensation circuit of FIG. 4 causing an output voltage error or introduce an error in the current limit circuit of FIG. 3 so that it trips prematurely or too late).

Implementations of the bias circuits described herein (e.g., implementations of the bias circuit 204 or the bias circuit 410) may also be used in circuits other than current mirror circuits to bias a low threshold voltage transistor for saturation mode operation over temperature.

In this description, the term "couple" may cover connections, communications, or signal paths that enable a functional relationship consistent with this description. For example, if device A generates a signal to control device B to perform an action, then: in a first example device A is coupled to device B, or in a second example device A is coupled to device B through intervening component C if intervening component C does not substantially alter the functional relationship between device A and device B, such that device B is controlled by device A via the control signal generated by device A.

Modifications are possible in the described embodiments, and other embodiments are possible, within the scope of the claims.

What is claimed is:

1. A circuit, comprising:
a first transistor including:
a gate; and
a drain; and
a bias circuit including:
a second transistor including:
a first current terminal coupled to a power supply terminal; and
a second current terminal;
a third transistor including:
a first current terminal coupled to a ground terminal; and
a second current terminal; and
a resistor having first and second resistor terminals, in which: the first resistor terminal is coupled to the second current terminal of the second transistor and to the drain of the first transistor; and the second resistor terminal is coupled to the second current terminal of the third transistor and to the gate of the first transistor;
wherein the second transistor is configured to source a current to the resistor, the third transistor is configured to sink the current from the resistor, a drain-to-source voltage across the first transistor is equal to a sum of a gate-to-source voltage of the first transistor and a voltage across the resistor, and the bias circuit is configured to bias the first transistor to operate in a saturation mode when a threshold voltage of the first transistor is a negative voltage.

2. The circuit of claim 1, wherein the bias circuit further includes:
a fourth transistor including:
a first current terminal coupled to the power supply terminal;
a control terminal coupled to a control terminal of the second transistor; and
a second current terminal coupled to the control terminal of the fourth transistor.

3. The circuit of claim 2, further comprising:
a current source including:
a first terminal coupled to the second current terminal of the fourth transistor; and
a second terminal coupled to the ground terminal.

4. The circuit of claim 1, wherein the bias circuit further includes:
a fourth transistor including:
a first current terminal coupled to the power supply terminal; and
a control terminal coupled to a control terminal of the second transistor.

5. The circuit of claim 4, wherein:
the fourth transistor further includes a second current terminal; and
the bias circuit further includes:
a fifth transistor including:
a first current terminal coupled to the second current terminal of the fourth transistor;
a second current terminal coupled to the ground terminal; and
a control terminal coupled to the first current terminal of the fifth transistor.

6. The circuit of claim 1, wherein the first transistor is a p-channel field effect transistor.

7. The circuit of claim 1, wherein the first transistor is an n-channel field effect transistor.

8. A current mirror circuit, comprising:
a first current mirror transistor including:
a gate; and
a drain;
a second current mirror transistor including a gate coupled to the gate of the first current mirror transistor; and
a bias circuit configured to bias the first current mirror transistor to operate in a saturation mode when a threshold voltage of the first current mirror transistor is a negative voltage;
wherein the bias circuit includes a resistor and first and second current mirrors, the resistor has first and second resistor terminals, the first resistor terminal is coupled to the first current mirror and to the drain of the first current mirror transistor, the second resistor terminal is coupled to the second current mirror and to the gate of the first current mirror transistor, the first current mirror is configured to source a current to the resistor, the second current mirror is configured to sink the current from the resistor, and a drain-to-source voltage across the first current mirror transistor is equal to a sum of a gate-to-source voltage of the first current mirror transistor and a voltage across the resistor.

9. The current mirror circuit of claim 8, wherein the bias circuit is configured to provide the drain-to-source voltage across the first current mirror transistor that is greater than or equal to the gate-to-source voltage of the first current mirror transistor minus the threshold voltage of the first current mirror transistor.

10. The current mirror circuit of claim 8, wherein the first current mirror includes:
a first bias circuit transistor connected as a diode, and having a threshold voltage; and
a second bias circuit transistor having a threshold voltage and configured to source the current to the resistor.

11. The current mirror circuit of claim 10, wherein the current is a first current, and wherein:
the second current mirror includes:
a third bias circuit transistor connected as a diode, and having a threshold voltage; and
a fourth bias circuit transistor having a threshold voltage and configured to sink the first current from the resistor; and
the first current mirror further includes a fifth bias circuit transistor configured to source a second current to the third bias circuit transistor.

12. A linear voltage regulator, comprising:
a current mirror circuit including:
a first current mirror including:
a first transistor including:
a gate; and
a drain; and
a second transistor including a gate coupled to the gate of the first transistor; and
a bias circuit including:
a second current mirror;
a third current mirror; and
a resistor having first and second resistor terminals, in which: the first resistor terminal is coupled to the second current mirror and to the drain of the first transistor; and the second resistor terminal is coupled to the third current mirror and to the gate of the first transistor;
wherein the second current mirror is configured to source a current to the resistor, the third current mirror is configured to sink the current from the resistor, a drain-to-source voltage across the first transistor is equal to a sum of a gate-to-source voltage of the first transistor and a voltage across the resistor, and the bias circuit is configured to bias the first transistor to operate in a saturation mode when a threshold voltage of the first transistor is a negative voltage.

13. The linear voltage regulator of claim 12, wherein the second current mirror includes:

a first bias circuit transistor connected as a diode and including:

a drain; and a gate coupled to the drain of the first bias circuit transistor;

a second bias circuit transistor including:

a gate coupled to the gate of the first bias circuit transistor; and a drain coupled to the resistor; and a third bias circuit transistor including:

a gate coupled to the gate of the first bias circuit transistor; and a drain.

14. The linear voltage regulator of claim 13, wherein the third current mirror includes:

a fourth bias circuit transistor connected as a diode and including:

a drain coupled to the drain of the third bias circuit transistor of the second current mirror; and a gate coupled to the drain of the fourth bias circuit transistor;

a fifth bias circuit transistor including:

a gate coupled to the gate of the fourth bias circuit transistor; and a drain coupled to the resistor.

15. The linear voltage regulator of claim 13, wherein the bias circuit further includes a current source coupled to the drain of the first bias circuit transistor.

* * * * *